US005668444A

United States Patent [19]

Pacholok

[11] Patent Number: 5,668,444

[45] Date of Patent: Sep. 16, 1997

[54] SOFT-TRANSITION FSK DIMMER FOR GASEOUS LUMINOUS TUBE LIGHTS

[75] Inventor: David R. Pacholok, Sleepy Hollow, Ill.

[73] Assignee: Everbrite, Inc., Greenfield, Wis.

[21] Appl. No.: 261,405

[22] Filed: Jun. 17, 1994

[51] Int. Cl.[6] ..... H05B 37/02

[52] U.S. Cl. ..... 315/224; 315/DIG. 4; 315/219; 315/291

[58] Field of Search ..... 315/DIG. 4, 219, 315/291, 307, 224

[56] References Cited

U.S. PATENT DOCUMENTS

| | | | |
|---|---|---|---|
| 4,612,479 | 9/1986 | Zansky | 315/194 |
| 4,680,508 | 7/1987 | Rucki | 315/166 |
| 4,704,563 | 11/1987 | Aussey | 315/307 |
| 4,717,863 | 1/1988 | Zeiler | 315/307 |
| 4,926,097 | 5/1990 | Taek | 315/307 |
| 5,097,181 | 3/1992 | Kakitani | 315/209 R |
| 5,105,127 | 4/1992 | Lavaud et al. | 315/291 |
| 5,302,083 | 4/1994 | Bucher et al. | 315/219 X |
| 5,406,174 | 4/1995 | Slegers | 315/219 |

FOREIGN PATENT DOCUMENTS

| | | | |
|---|---|---|---|
| 0044366 | 4/1979 | Japan | 315/219 |
| 3263797 | 11/1991 | Japan | 315/291 |

*Primary Examiner*—Robert Pascal
*Assistant Examiner*—Arnold Kinkead
*Attorney, Agent, or Firm*—R. Winston Slater

[57] ABSTRACT

A dimmer oscillator for a high frequency luminous tube power supply including a frequency shiftable high frequency oscillator, a variable duty cycle low frequency oscillator operatively connected to the high frequency oscillator for controlling the high frequency oscillator between a first normal output operating frequency and a second higher frequency. A low pass filter within the high frequency supply whereby the supply output to a luminous tube load is reduced, when the oscillator is operating at the second higher frequency, to a low intensity ionization maintenance level. An integrator between the low and high frequency oscillators whereby the transition between the first nominal and second higher operating frequencies is smoothed to reduce acoustic noise and false GFI and OVP triggering. A frequency control diode between the low and high frequency oscillators to limit the lower frequency excursion, and to maintain oscillation of, the high frequency oscillator.

5 Claims, 6 Drawing Sheets

SOFT-TRANSITION FSK DIMMER FOR GASEOUS LUMINOUS TUBE LIGHTS

BACKGROUND OF THE INVENTION

The present invention relates to high frequency, high voltage power supplies for gaseous luminous tube lighting of the type commonly found in commercial and decorative home and commercial applications. Such lighting may be of either the neon or mercury type, or both, depending on the colors desired. More specifically, the present invention relates to an improved dimmer apparatus for controlling the intensity of such luminous tubes.

Most conventional high frequency neon power supplies operate at a fixed current output determined by power supply design and the length of the neon tube or tubes connected thereto. Such supplies are, in short, operated at a single output level corresponding to full or maximum light intensity.

While fixed full-output neon supplies are satisfactory for most applications—usually for outdoor or window advertisement applications—there is growing demand for lower or variable intensity neon signage principally for indoor applications where normal high intensity illumination does not comport with the subdued and darkened atmosphere associated with many food and beverage establishments—common users of neon signage. The present invention, therefore, pertains to a dimmer arrangement for high frequency neon power supplies that permits the continuous adjustment of light output from full intensity down to a low light output level of, for example, about 5–10% thereof.

In certain instances a conventional SCR or triac-type 'conduction angle' or pulse width modulation (PWM) lamp dimmer may be employed to vary the light intensity, particularly where the neon sign is powered from a standard 60 Hz power transformer supply. And it might reasonably be assumed that the PWM dimming scheme could be extrapolated to high frequency neon power supplies as this is the principle upon which many high frequency switching power supplies operate.

Several problems, however, have been encountered when applying PWM dimmer technology to high frequency neon power supplies. These include the non-uniform illumination of the neon tube and the lowering of the output voltage below that necessary to assure neon gas excitation—both phenomena occurring at lower illumination intensities.

As presently understood, the reason for the first of these limitations is related to the distributed tube capacitance which may be as high as 50 picofarads or more. This capacitance progressively shunts tube current to ground along the length of the tube, that is, as viewed by moving from the respective tube ends toward the center. As the voltage across the tube is substantially independent of tube current (actually, the negative resistance characteristic of the neon tube results in a slightly increasing tube voltage with lowering tube currents), this capacitive leakage current is also substantially independent of tube illumination or dimmer setting. For a 20 KHz neon supply and typical neon tube, this current is approximately 12 milliamperes.

By comparison, a neon tube current of about 25 milliamperes is typical for normal (full) neon tube illumination. As these two current components (i.e. tube leakage and tube illumination currents) are in quadrature, a total supply current of under 28 ma results. Thus, it will be appreciated that the leakage current causes only a negligible reduction in neon tube current for normal tube illumination intensities and consequently this gradual current reduction along and toward tube center produces a correspondingly trivial reduction in light intensity.

This is not the case for lower tube illumination intensities, however. Take, for example, a tube dimming of 80%, that is, where the desired tube current is 20% of full tube intensity current or 5 ma. For this configuration (i.e. quadrature leakage and illumination currents of 12 and 5 ma, respectively) the total supply current is computed to be 13 ma. It should be observed, however, that the full 13 ma supply current enters the neon tube ends as all of the capacitive leakage and tube neon currents flow through these points. Thus, the tube ends are illuminated not by a mere 5, but a 13, milliampere current.

The current through the center section of the tube (which is at "ground" potential by reason of the balanced nature of the supply output), however, is the previously specified 5 ma—the 12 ma quadrature leakage current having been fully shunted to ground. The tube is therefore illuminated to a 5 ma intensity in the center, but gradually increases to 13 ma at the ends. This differential produces a clearly visible and objectionable illumination non-uniformity that only gets worse as greater dimming levels are selected.

The second limitation of PWM neon supplies relates to the intrinsic low pass filter characteristic of the power supply and neon load. This filter characteristic—which has a cut-off frequency generally of twice the supply operating frequency—is created by the series equivalent inductance of the high voltage transformer working against the secondary capacitance and the previously mentioned tube leakage capacitance.

The oscillator output waveform, for ordinary 'full output' operation, is of generally symmetrical form having substantial energy at the fundamental or operating frequency. Thus, the above-mentioned low pass characteristic is of minimal consequence for ordinary operation. However, as the pulse widths are narrowed by the PWM circuitry (as occurs upon dimming with this conventional approach), the relative fundamental energy content of the resulting output waveform drops dramatically. And by reason of the above-discussed low pass filter characteristic, the remaining high frequency harmonic energy is not coupled to the neon tube and therefore does not significantly contribute to the available excitation voltage thereof. As dimming is increased (i.e. as the pulse widths narrow) the neon tube excitation voltage may drop below the requisite ionization potential thereby resulting in erratic and unreliable tube operation, specifically, the failure of the tube to illuminate or an oscillatory-type flickering or blinking thereof.

It must be emphasized at this juncture that the above-described low pass characteristic, while fatal to PWM dimming, is central to the present invention. An important distinction is that in the PWM dimmer the narrowed pulses are utilized in an attempt to achieve illumination (albeit, at a reduced intensity) while in the present invention the narrowed pulses contribute no illumination, but are used solely to maintain residual ionization. The illumination intensity of the present dimmer is determined by the 'duty cycle' or 'on' time of full output, normal frequency and width pulses. This latter 'full output' dimming technique being a form of Pulse Group Modulation (PGM).

Applicant previously developed a luminous tube dimmer employing the principle of Pulse Group Modulation ("PGM") in which full amplitude high frequency pulse groups were generated at relatively low frequency repetition rate. The intensity, or dimming, was controlled by adjusting the number of high frequency cycles comprising each pulse group. This approach was described in U.S. application Ser. No. 980,539 filed on Nov. 13, 1992, now U.S. Pat. No. 5,349,273. As noted in that application, certain anomalies associated with the transient turn-on phase of each pulse group required special treatment in order to obtain satisfactory ground fault interruption ("GFI ") and over-voltage protection ("OVP") capability. Specifically, GFI operation had to be 'blanked' or inhibited during this transient phase of each pulse group in order to preclude false GFI sensing. While this approach has proved satisfactory, it nonetheless represents a compromise in GFI operation.

A second problem encountered with PGM (in particular with the sharp rise-time of each pulse group) relates to acoustic noise or 'clicking'. As currently understood, these clicks are caused by slight mechanical movements of the transformer core or windings and result in an annoying buzz at the low frequency PGM repetition rate.

The present invention, by contrast, employs a combination of shifting the 'energy' of the high frequency oscillator (upwardly) and generating a 'soft' transition between the normal and shifted oscillator modes to provide for dimming without the above-noted problems. More specifically, the present high frequency oscillator is never turned-off, rather, its energy is shifted upwardly in frequency an amount sufficient to take advantage of the inherent multi-pole low-pass characteristic defined by the intrinsic (and unavoidable) load and supply reactances.

Thus, the oscillator—although superficially operating normally—nevertheless provides a substantially reduced excitation to the load during such 'shifted' intervals whereby only a minimal amount of tube illumination occurs. Yet, the high frequency oscillator is still operational and generating sufficient excitation to preionize the luminous tube load thereby greatly diminishing transient over-voltage and GFI problems at the commencement of each non-shifted 'on' cycle. To further minimize generation of false GFI and over voltage signals, oscillator shifting is slowed, that is, gradually moved between its two frequency extremes over, for example, a 400–800 μSec period. It will be appreciated that the degree of dimming may therefore be set by correspondingly adjusting the duty cycle of the respective 'normal' and 'shifted' energy modes of the high frequency oscillator. Typical 'normal' and 'shifted' frequencies of operation are about 20 KHz and 40–50 KHz, respectively.

To further take advantage of the above-described low pass filter effect, the duty cycle of the high frequency oscillator is altered, simultaneously with the upward shift in frequency, to a less symmetric 'square wave' (i.e. one having successive 'half-cycles' of progressively disproportionate duration). This latter effect causes an increase in the harmonic content of the oscillator output (comparative to the fundamental component) which, in turn, results in even less energy being passed to the luminous tube during these 'shifted' periods. As a consequence, a typical luminous tube current of 30 milliamperes drops to about 5 milliamperes under the above-described frequency/waveform shifts.

A further feature of the present invention is the employment of integration on the high frequency oscillator frequency control input whereby the frequency of this oscillator transitions smoothly between its normal and shifted modes (and visa versa). By reason of the above-noted intrinsic 'low pass' contour, these smoothed frequency transitions result in correspondingly smoothed power supply output amplitude changes which, in turn, eliminating the sudden electronic impulses believed responsible for the objectionable clicking and buzzing noises.

It is therefore an object of the present invention to provide an improved neon luminous tube dimmer that does not exhibit the annoying clicking and buzzing noises found in connection with certain pulse group modulation dimming arrangements. It is an object of the present dimmer to employ periodic upward shifting of the oscillator frequency/energy—working into the intrinsic low pass response associated with the high frequency transformer and luminous tube load—to effect a substantial reduction in luminous tube current and reduction in light output and to selectively adjust the percentage of time that the oscillator is 'shifted' to thereby correspondingly adjust the degree of dimming. It is a further object to enhance the dimming function by altering the high frequency oscillator waveform to thereby augment the upward shifting of the oscillator output by reason of increasing the percentage harmonic content thereof. It is yet another object to control and slow the rate of transition between the oscillator 'shifted' and 'un-shifted' modes to thereby minimize the generation of annoying acoustic clicking and buzzing.

DESCRIPTION OF THE PREFERRED EMBODIMENT

Figure 1A:
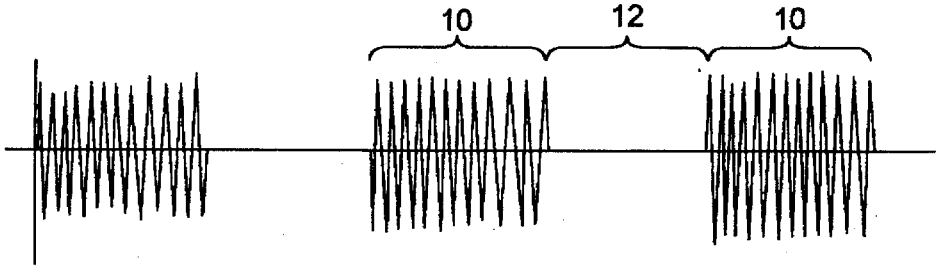
FIG. 1*a* is the voltage waveform of a high frequency, low power oscillator of a PGM dimmer shown partially dimmed at 40 percent 'on' and 60 percent 'off'.
Figure 1B:
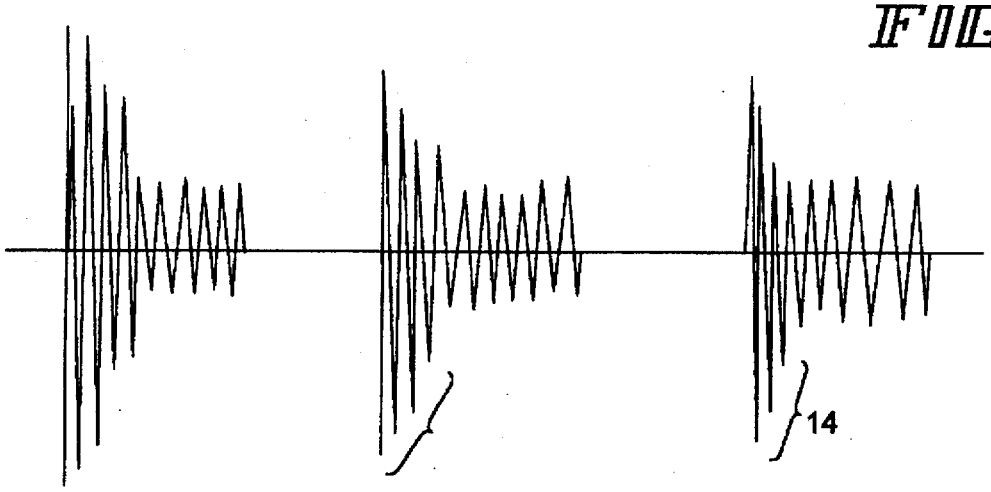
FIG. 1*b* is the voltage waveform across a gaseous tube load of the high frequency PGM power supply employing the oscillator of FIG. 1*a;*
Figure 2A:
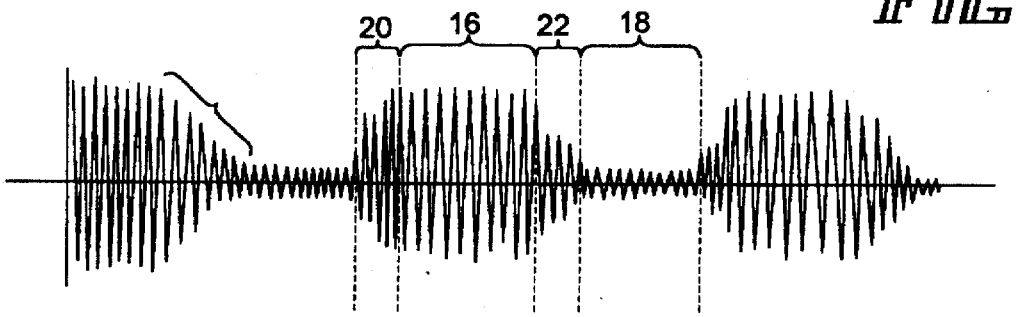
FIG. 2*a* is the voltage waveform of a high frequency, low power oscillator of the dimmer of the present invention shown partially dimmed at 40 percent 'on' and 60 percent 'off'.
Figure 2B:
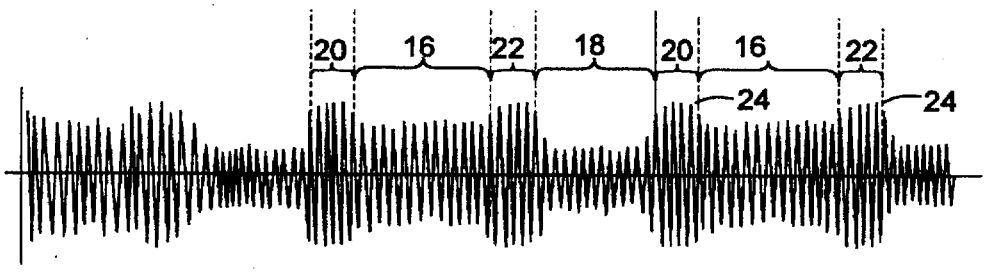
FIG. 2*b* is the voltage waveform across a gaseous tube load of the high frequency power supply employing the oscillator of FIG. 2*a;*

FIGS. 1 and 2 are comparative waveforms showing Applicant's prior PGM dimmer (FIGS. 1*a* and 1*b*) and the present soft-transition energy shift dimmer (FIGS. 2*a* and 2*b*). More specifically, FIG. 1*a* represents the primary waveform of the high frequency output transformer (e.g. transformer 60, FIG. 6) of a PGM dimmer operating on a 40/60 duty cycle wherein the oscillator is 'on' 10 and 'off' 12 for 40% and 60% intervals, respectively. A typical oscillator frequency during the 'on' interval is in the order of 20–25 KHz (the oscillator otherwise being 'off'). A pulse group rate of 100 Hz is typical.

The actual output waveform appearing across the luminous tube load for the PGM supply is shown in FIG. 1*b*. This figure reveals a shortcoming of the PGM approach, namely, the presence of a high voltage transient 'spike' 14 during the first 200–400 μSec of each new pulse group. This spike occurs due to the near-infinite resistance of the yet unionized gaseous tube segment which, by reason of this power supply 'unloading', permits the output voltage thereof to soar. As the gases ionize and conduct, the output voltage drops to its nominal design level. It is this voltage peak, and the unbalanced tube currents that propagate along the tube's length during initial ionization, that lead to false triggering of the ground fault ("GFI") and over-voltage ("OVP") detector circuits.

FIGS. 2*a* and 2*b* illustrate the corresponding transformer primary and luminous tube voltage waveforms for the present dimmer operating, also, at a 40/60 duty cycle. The 'on' interval 16 is substantially identical to the 'on' interval 10 of the PGM dimmer. Both oscillators operate at full output during these 'on' intervals (i.e. corresponding to maximum luminous tube brightness) and at a frequency, as noted, of approximately 20 KHz.

It is during the so-called 'off' interval 18 (and the transitions 20 and 22 therebetween) that the significant differences and improvements of the present soft-transition, frequency shift dimmer are revealed. Unlike the oscillator of FIG. 1, the present oscillator does not turn 'off' during intervals 18. Rather, by reason of the upward shift in oscillator energy and the inherent low pass 'filtering' (attributed to the stray reactances of the oscillator and load), the luminous tube voltage (and the corresponding tube current) drop significantly to a low, near-zero illumination level 18, but a level that nevertheless maintains gas ionization within the luminous tube. As a consequence of this continuing ionization of the luminous load, the power supply never operates into an open-circuit load condition. And it follows that the transient—caused in the first instance by operation of the supply prior to tube ionization—is largely eliminated. A typical oscillator frequency during the 'off' interval 18 is in the order of 40–50 KHz.

Figure 6:
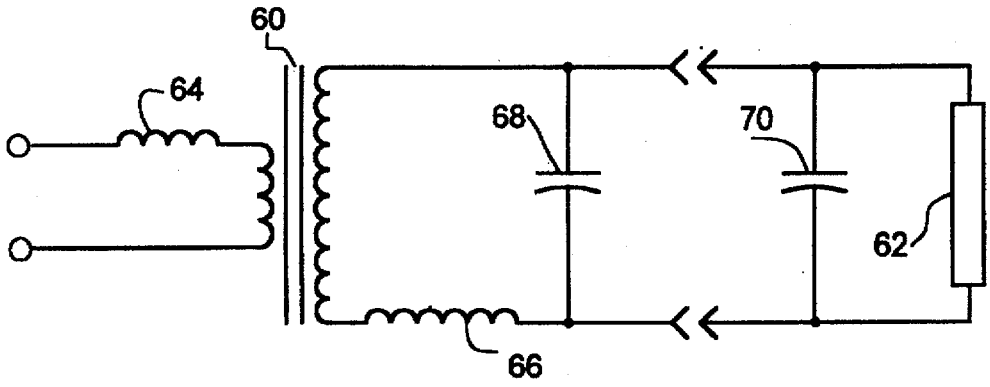
FIG. 6 is a schematic representation of the equivalent circuit of the output transformer and luminous tube load used in the power supply of the present invention.
Figure 7:
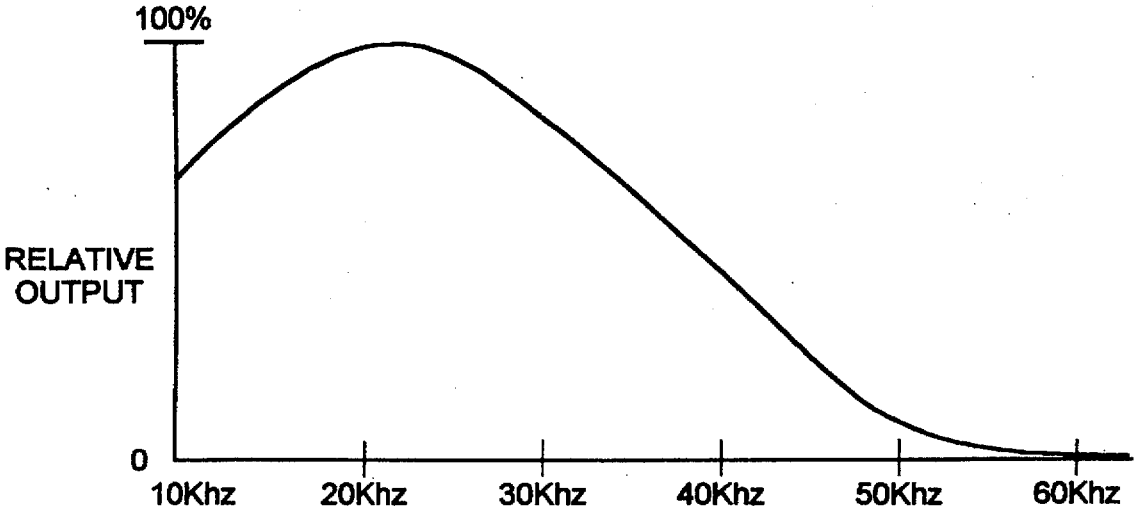
FIG. 7 is a curve of the output level verses frequency of the present supply utilizing the output transformer of FIG. 6.

As noted above with reference to FIG. 2*b*, the output across the luminous load drops significantly during the intervals 18 in which the frequency of the power supply is shifted. This reason for this output reduction will become apparent by reference to FIGS. 6 and 7 wherein FIG. 6 represents the equivalent circuit of a typical power supply output transformer 60 and attached load 62 while FIG. 7 plots the frequency response of the circuit of FIG. 6. Inductances 64 and 66 are the respective primary and secondary inductances, and capacitance 68 is the stray secondary capacitance, found in any practically realizable transformer, such as transformer 60. The luminous tube load 62 also exhibits a stray capacitance 70 which acts in parallel with transformer capacitance 68. In combination, these intrinsic reactances produce the low pass characteristic shown in FIG. 7 and it will be appreciated that the present invention advantageously utilizes this natural phenomenon—thereby avoiding additional complexity—to effect the required output reduction simply by shifting the supply energy into the region of increased attenuation or loss. (See FIG. 7).

Figure 10A:
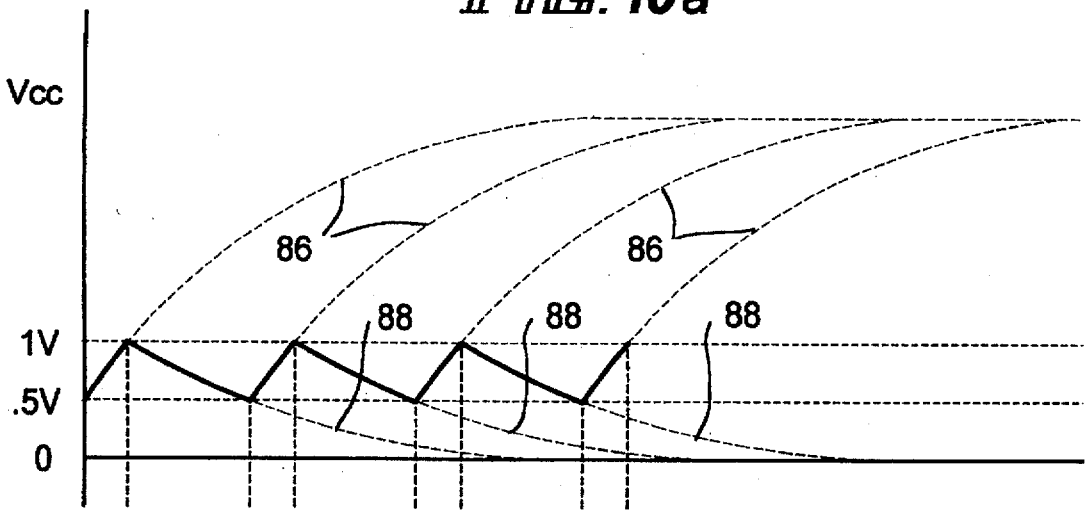
FIG. 10*a* is the voltage waveform across the timing capacitor of the high frequency oscillator of FIG. 9 during the energy shifted intervals of each low frequency dimming cycle; and, FIG. 10*b* is the output waveform of the high frequency oscillator during the energy shifted intervals of FIG. 10.
Figure 10B:
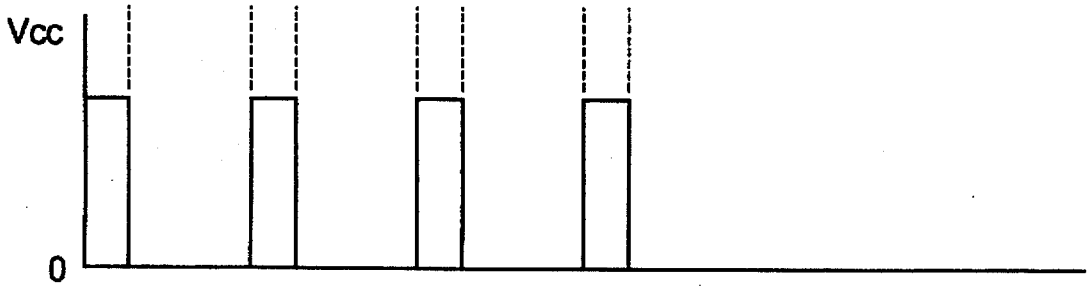

This region of increased attenuation is advantageously utilized both by upwardly shifting the actual frequency of operation of the high frequency oscillator and by narrowing the pulses of the high frequency output from its conventional quasi-square waveform to a non-symmetrical waveform as shown in FIGS. 10*a* and 10*b* and described in more detail below.

A further aspect of the present invention directed to the minimization of false GFI and OVP triggering as well as the above-noted clicking/buzzing noise is the 'soft transition' switching, at 20 and 22, between the full intensity 'on' 16 and ionization-sustaining 'off' 18 intervals. Although the present oscillator remains active throughout the entire dimming cycle (i.e. during both the 'on' and 'off' periods), it will be appreciated that there is, and must be, a substantial increase in current through the luminous tube and supply output transformer during the 'on' intervals in order to achieve proper tube illumination and dimming control. And notwithstanding the maintenance of low level tube ionization during the 'off' intervals 18, any sudden change in output current may result in the continued generation of the noise and GFI and OVP false triggering.

FIG. 2*b* depicts the voltage across the luminous tube load connected to the dimming supply of the present invention. It will be observed that the load voltage rises slightly at 24 notwithstanding implementation of the above-described continuous operation and soft transition. These peaks 24 occur within the negative resistance region of the ionized gas medium wherein the effective voltage of the load actually increases as the tube current decreases. This known phenomenon results in a partial 'unloading' of the supply during the transition intervals 20 and 22 which, in turn, is manifested by a slight increase in load voltage. This increase, however, is generally not significant enough to falsely trigger the over voltage detector.

The present invention is particularly suited to high frequency supplies of the type employing a low power oscillator (such as, for example, the well-known 555 timer/oscillator) that is, in turn, operatively connected to a controller/switcher to effect the alternate switching of the DC power source across the primary of the supply output transformer. While the teachings herein are applicable to other oscillator topologies, the preferred embodiment described hereinafter represents a component-efficient and therefore low cost implementation of a neon dimmer supply—an important consideration in the high volume and price competitive neon power supply marketplace.

Figure 3:
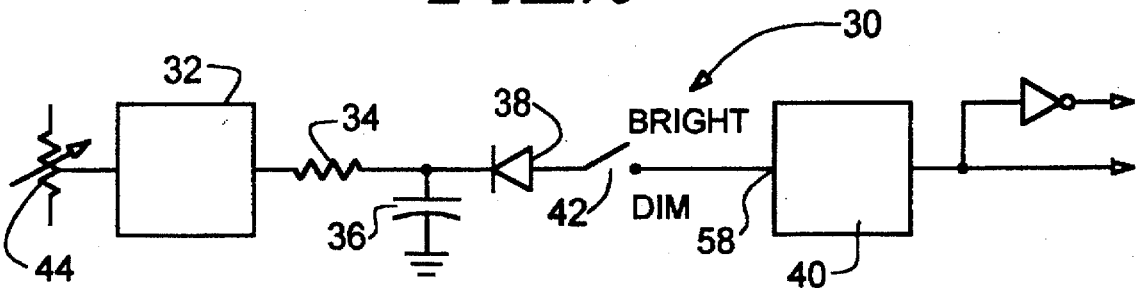
FIG. 3 is a partial schematic and partial block representation of the dimmer of the present invention.

Referring to FIG. 3, the dimmer power supply 30 of the present invention is shown including a variable duty-cycle low frequency oscillator 32, an integrator comprised of RC network 34 and 36, a frequency control diode 38, and a 555 type frequency controllable high frequency oscillator 40. A switch 42 may be added to disable dimming, i.e. dimming 'on/off', and a control 44 is provided to adjust the duty cycle of the low frequency oscillator 32 to thereby correspondingly set the dimming level (as set forth in more detail below).

Figure 4:
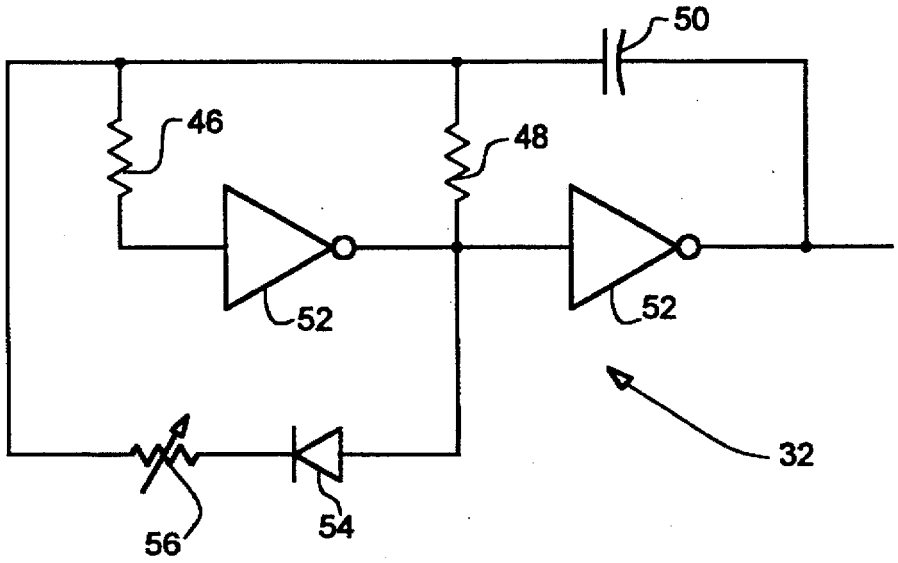
FIG. 4 is a schematic representation of the low frequency, variable duty cycle oscillator of the dimmer of FIG. 3.

Low frequency oscillator 32 preferably operates around 100 Hz and may be of conventional design including, for example, a 555 timer/oscillator, or a pair of inverters arranged as shown in FIG. 4. The oscillator of FIG. 4 is found in the CMOS 4060 oscillator/counter integrated circuit and has been used in connection with the present invention whereby the remaining counter portion of the 4060 device may advantageously be used in connection with the generation of a symmetrically reversing asymmetrical waveform—an advantageous feature of neon/mercury high frequency power supply technology, but forming no part of the present disclosure.

Figure 5A:
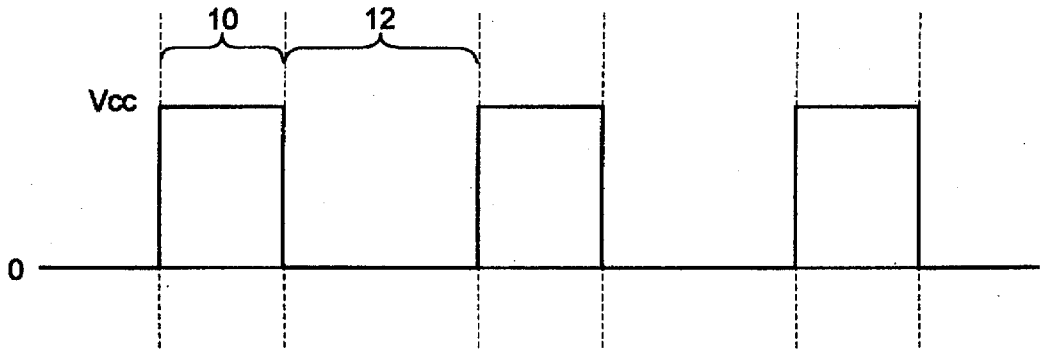
FIG. 5*a* is a voltage waveform of the output of the low frequency oscillator of FIG. 4.

Still referring to FIG. 4, resistors 46 and 48 (typically 1MΩand capacitor 50 (typically 0.047 μf) define, in combination with the two inverters 52, a 50/50 duty cycle oscillator of conventional design. Duty cycle control (FIG. 4) is implemented by diode 54 and variable resistor 56 (typically 1MΩ). As resistance 56 is lowered, the duty cycle of oscillator 32 is progressively lowered down to the order of 10% thereby effecting luminous tube dimming as described herein. FIG. 5*a* illustrates a typical oscillator 32 output waveform adjusted to a 40% (i.e. 40/60) duty cycle.

Figure 5B:
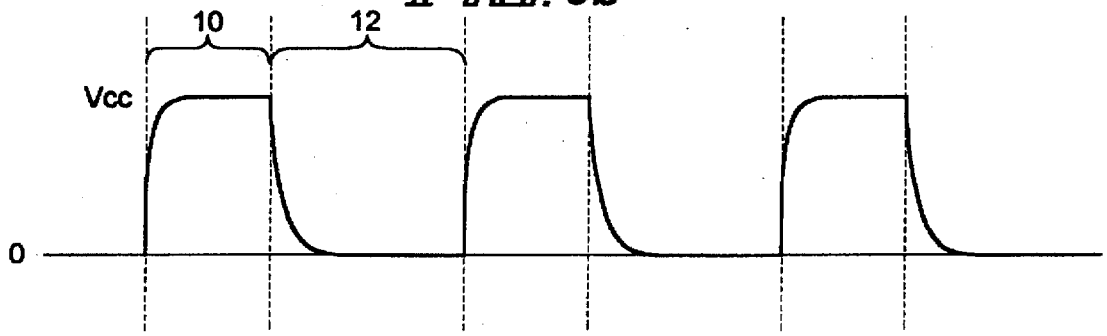
FIG. 5*b* is a voltage waveform of the output of the RC integrator network of FIG. 3.

The oscillator output is thereafter applied to an RC network 34, 36 that performs an integrating function. A 0.5-1 millisecond time-constant is nominal for a 100 Hz low frequency oscillator thereby providing significant protection against transients (and false GFI and OVP triggering) while maintaining settled, quiescent operation of the high frequency oscillator during most of its respective 'on' and 'off' segments. FIG. 5*b* illustrates the integrator output waveform (i.e. at the cathode of diode 38, FIG. 3).

The output from RC network 34, 36 is connected, through control diode 38 discussed immediately below, to the frequency control input 58 of high frequency oscillator 40. Oscillator 40 is preferably of the conventional 555 variety whereby both frequency and pulse width may be controlled to effect luminous tube dimming as described herein.

Frequency control diode 38 performs two important functions. First, and referring to FIG. 5*c*, this diode precludes the voltage at the frequency control input 58 of oscillator 40 from rising above ⅔ $V_{cc}$ ($V_{cc}$ being the supply voltage used to power oscillators 32 and 40). The frequency control input of the 555 (pin 5), for example, is self-biased to ⅔ $V_{cc}$ and therefore diode 38 becomes back-biased and inert as the voltage from the RC network approaches and/or rises above this preset level. Second, the forward voltage drop of diode 38 serves to level-shift the voltage from the RC network whereby the voltage at the oscillator control input 58 does not drop below about 1 volt. It will be understood that the above discussion, and the waveform of FIG. 5*c*, apply when the dim/bright switch 42 is in the 'dim' position, that is, when the switch is closed.

Failure to limit the oscillator frequency control voltage to ⅔ $V_{cc}$ will result in the operating frequency dropping below its nominal 20 KHz level (which could result in the generation of an audible whine) while failure to limit the low voltage swing of the frequency control input will result in cessation of oscillation which, it will be appreciated, defeats the low-level ionization of the gaseous load during the dim portion of each low frequency cycle. A frequency control voltage of ⅔ $V_{cc}$ represents normal operation (i.e. full light intensity, see FIG. 2 at 10) of the 555 high frequency oscillator, i.e. 20 KHz, while the lower control voltage of 1 volt represents the 'dimmed mode' of operation in which the oscillator 40 frequency is shifted to about 40–50 KHz and the level of tube illumination and gas ionization is at its lowest, sustenance level (see FIG. 2 at 12).

As previously noted, the region of increased attenuation of the inherent low pass characteristic may advantageously be utilized, first, by increasing the frequency of power supply operation and, second, by decreasing the pulse width from oscillator 40 to thereby increase the oscillator harmonic content. This increase in harmonic energy raises the effective attenuation by shifting the energy of the output upwardly, i.e. further into the low pass, high attenuation portion of the curve of FIG. 7. The frequency shifting and pulse width modification will be understood by reference to FIGS. 5*d*, 8–10 and the discussion that follows.

Figure 8A:
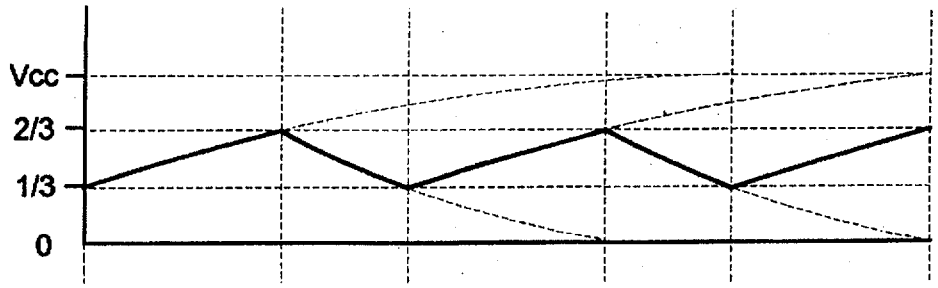
FIG. 8*a* is the voltage waveform across the timing capacitor of the high frequency oscillator of FIGS. 3 and 9 during normal full brightness operation of the oscillator.
Figure 8B:
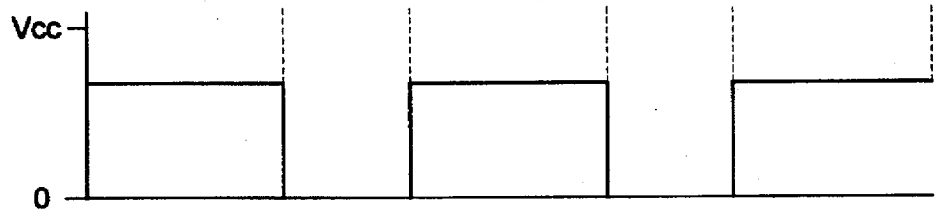
FIG. 8*b* is the output waveform of the high frequency oscillator of FIGS. 3 and 9 during the normal full brightness operation of FIG. 8*a;*
Figure 9:
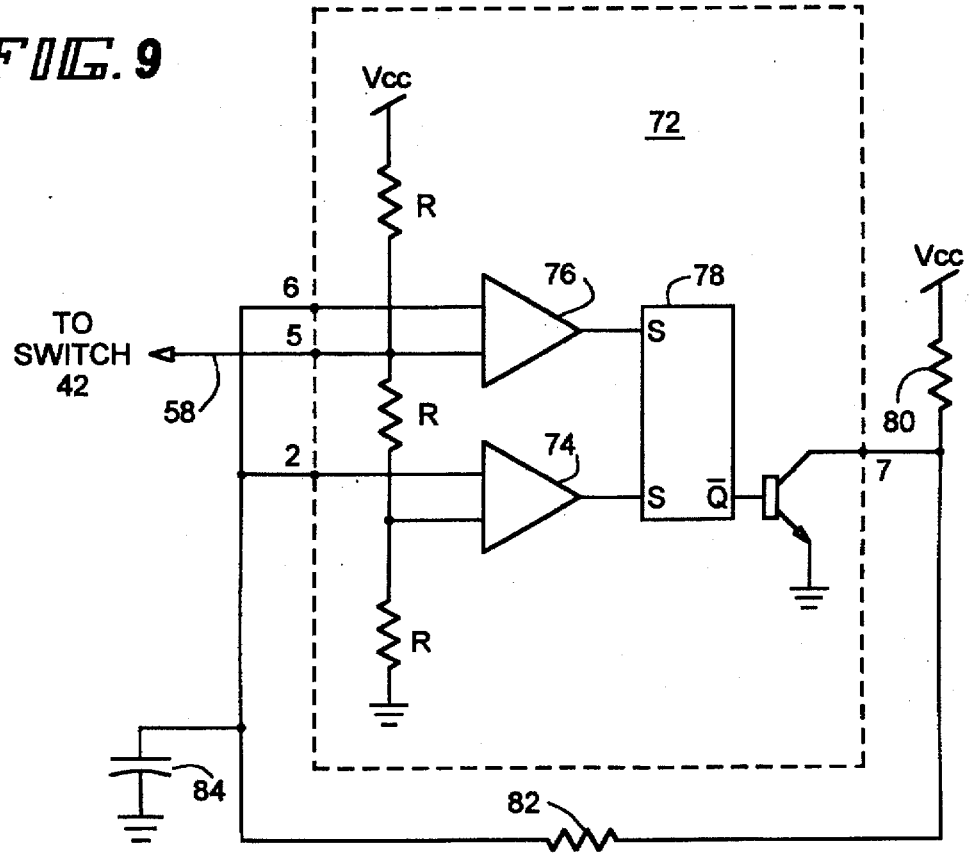
FIG. 9 is a schematic diagram of the high frequency oscillator of the dimmer of FIG. 3.

Shown within the dotted perimeter on FIG. 9 are the essential elements of the 555 timer/oscillator 72 including a pair of comparators 74 and 76 having respective, nominal thresholds of ⅓ $V_{cc}$ and ⅔ $V_{cc}$ established by the three equal resistors R. As is well known in the art, flip-flop 78 is alternately 'set' and 'reset' as the comparator input voltage (pins 2 and 6) increases to ⅔ $V_{cc}$ and decreases to ⅓ $V_{cc}$. Resistors 80 and 82 and capacitor 84 are selected in the well-known and published manner to generate a quasi-square wave output (FIG. 9, pin 7) of approximately 20 KHz. FIG. 8*b* depicts this output with FIG. 8*a* representing the corresponding waveform across capacitor 84. It should be noted that switch 42 (FIG. 3) is in the 'open' or maximum brightness position.

With switch 42 'closed', however, the reference voltages for the comparators 74 and 76 (through connection to pin 5) are forced to assume differing levels in accordance with the output of low frequency oscillator 32 as modified by the frequency control diode 38 (FIG. 3). As previously noted, oscillator 32 provides a variable duty cycle low frequency square wave output that transitions between essentially the power source voltage, $V_{cc}$, and near-ground potential (i.e. between 0.1 and 0.5 volts).

Figure 5C:
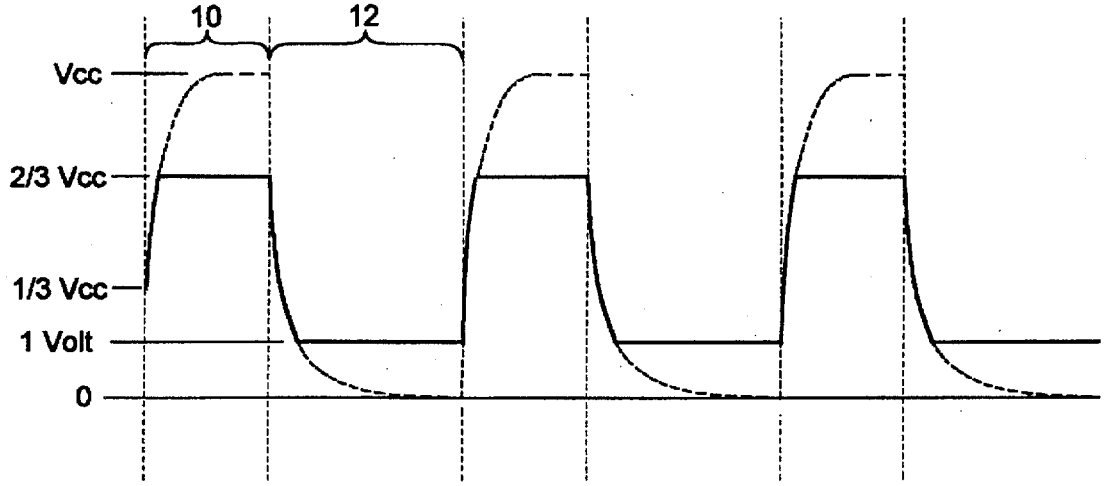
FIG. 5*c* is a voltage waveform of the output of the frequency control diode as connected to the high frequency oscillator of FIG. 3.

FIG. 5*c* illustrates this output as it ultimately appears on the frequency control input (pin 5) of the high frequency oscillator 40 (i.e. after passing through the previously discussed RC network 34,36 and control diode 38). Diode 38, again, serves to limit the maximum excursion of the control voltage between about 1 volt and ⅔ $V_{cc}$.

As mentioned, during the 'on' intervals 10 (FIG. 5) of low frequency oscillator 32 (FIG. 3), the voltage at frequency control input of oscillator 40 is the unaltered, internally biased level of ⅔ $V_{cc}$ and therefore oscillator 40 operates at its predetermined nominal full intensity operating frequency (e.g. 20 KHz) exhibiting the quasi-balanced square wave output of FIG. 8*b*.

On the other hand, during the intervening 'off' or low intensity intervals 18, the frequency control input is clamped to about 1 volt and the respective comparator 74 and 76 trigger levels are correspondingly about 0.5 and 1.0 volts. FIGS. 10*a* and 10*b* illustrate capacitor 84 and oscillator output waveforms during these 'off' intervals.

It should be noted that the oscillator output continues to switch between $V_{cc}$ and ground and therefore continues to charge and discharge capacitor 84 between these same levels as illustrated by respective 'charge' and 'discharge' dotted lines 86 and 88 (FIG. 10*a*). By reason of the lowered trigger levels, and as shown in FIG. 10*a*, the capacitor charge duration is greatly shortened (in comparison to the discharge duration) thereby significantly narrowing the percentage 'on' pulse width to as low as 15%. In this manner, the oscillator output power density is shifted upwardly into the aforementioned low pass cut-off region both by increasing the frequency and harmonic content thereof.

It is thought that the invention and many of its attendant advantages will be understood from the foregoing description, and it is apparent that various changes may be made in the form, construction and arrangement of its component parts without departing from the spirit and scope of the invention or sacrificing all of its material advantages, the forms described being merely preferred embodiments thereof.

In view of the above, we wish to be limited not by the specific embodiment illustrated but only by the scope of the appended claims wherein it is claimed:

What is claimed is:

1. A dimmer for a high frequency luminous tube power supply, the power supply having an output transformer operatively connected to the dimmer and an output for connection to a luminous tube load; the dimmer including a high frequency variable frequency oscillator having a frequency control input, the high frequency oscillator operating between first nominal and second higher frequencies corresponding to control input signal between first and second levels; a low frequency oscillator having an output operatively connected to the high frequency variable frequency oscillator control input, said low frequency oscillator alternately switching between first and second output signal levels corresponding generally to the first and second control input signal levels, respectively; low pass filtering means operatively associated with the power supply whereby the power supply provides output for full tube illumination when the supply is operated at the first nominal frequency and a substantially reduced output corresponding to low tube illumination when the supply is operated at the second higher frequency; duty-cycle control means operatively connected to the low frequency oscillator to selectively adjust the ratio of time that the output of the low frequency oscillator is in each of its two output signal levels whereby increased dimming may be achieved by increasing the percentage of time that the high frequency oscillator is operated at the second higher frequency; the output of the high frequency oscillator is a plurality of spaced pulses, means operatively associated with the high frequency oscillator frequency control input for narrowing the width of the spaced pulses as the frequency control input is advanced from first to second levels whereby the relative harmonic content of the high frequency oscillator output increases as the frequency thereof moves between first nominal and second higher frequencies whereby said increases in both oscillator frequency and harmonic content contribute to substantially reduce the output to low tube illumination.

2. A dimmer for a high frequency luminous tube power supply, the power supply having an output transformer operatively connected to the dimmer and an output for connection to a luminous tube load; the dimmer including a high frequency variable frequency oscillator having a frequency control input, the high frequency oscillator operating between first nominal and second higher frequencies corresponding to control inputs between first and second levels; a low frequency oscillator having an output operatively connected to the high frequency variable frequency oscillator control input, said low frequency oscillator alternately switching between first and second output signal levels corresponding generally to the first and second control input levels, respectively; low pass filtering means operatively associated with the power supply whereby the power supply provides output for full tube illumination when the supply is operated at the first nominal frequency and a substantially reduced output corresponding to low tube illumination when the supply is operated at the second higher frequency; duty-cycle control means operatively connected to the low frequency oscillator to selectively adjust the ratio of time that the output of the low frequency oscillator is in each of its two output signal levels whereby increased dimming may be achieved by increasing the percentage of time that the high frequency oscillator is operated at the second higher frequency; smoothing means between the output of the low frequency oscillator and the frequency control input of the high frequency oscillator whereby the control input transitions smoothly between the first and second levels over a predetermined period whereby the power supply output correspondingly transitions between full and low illuminations thereby minimizing false ground fault and over-voltage indications and acoustic noises.

3. A dimmer for a high frequency luminous tube power supply, the power supply having an output transformer operatively connected to the dimmer and an output for connection to a luminous tube load; the dimmer including a high frequency variable frequency oscillator having a frequency control input, the high frequency oscillator operating between first nominal and second higher frequencies corresponding to control inputs between first and second levels; a low frequency oscillator having an output operatively connected to the high frequency oscillator control input, said low frequency oscillator alternately switching between first and second output signal levels corresponding generally to the first and second control input levels, respectively; low pass means operatively associated with the power supply whereby the power supply provides output for full tube illumination when the supply is operated at the first nominal frequency and a substantially reduced output corresponding to low tube illumination when the supply is operated at the second higher frequency; duty-cycle control means operatively connected to the low frequency oscillator to selectively adjust the ratio of time that the output of the low frequency oscillator is in each of its two output levels whereby increased dimming may be achieved by increasing the percentage of time that the high frequency oscillator is operated at the second higher frequency; means disposed between the output of the low frequency oscillator and the control input of the high frequency oscillator for limiting the maximum excursions of the control input between said first and second levels corresponding to said first nominal and second higher oscillator frequencies.

4. A dimmer for a high frequency luminous tube power supply, the power supply having an output transformer operatively connected to the dimmer and an output for connection to a luminous tube load; the dimmer including a high frequency variable frequency oscillator having a frequency control input, the high frequency oscillator operating between first nominal and second higher frequencies corresponding to control inputs between first and second levels; a low frequency oscillator having an output operatively connected to the high frequency oscillator control input, said low frequency oscillator alternately switching between first and second output signal levels corresponding generally to the first and second control input levels, respectively; low pass means operatively associated with the power supply whereby the power supply provides output for full tube illumination when the supply is operated at the first nominal frequency and a substantially reduced output corresponding to low tube illumination when the supply is operated at the second higher frequency; duty-cycle control means operatively connected to the low frequency oscillator to selectively adjust the ratio of time that the output of the low frequency oscillator is in each of its two output levels whereby increased dimming may be achieved by increasing the percentage of time that the high frequency oscillator is operated at the second higher frequency; the low frequency oscillator includes first and second inverters, the output of the first inverter connected to the input of the second inverter and the output of the second inverter connected through a capacitor to first ends of a pair of resistors, the second ends of the pair of resistors being connected respectively to the inputs of the first and second inverters; the duty-cycle control means including a series connection of a diode and variable resistor connected between the second inverter input and a node defined by the interconnection of said pair of resistors and the capacitor, the diode being oriented whereby the flow of positive current is toward said node whereby adjusting the resistance of the variable resistor correspondingly adjusts the low frequency oscillator duty cycle.

5. A dimmer for a high frequency luminous tube power supply, the power supply having an output transformer operatively connected to the dimmer and an output for connection to a luminous tube load; the dimmer including a high frequency variable frequency oscillator having a frequency control input, the high frequency oscillator operating between first nominal and second higher frequencies corresponding to control inputs between first and second levels; a low frequency oscillator having an output operatively connected to the high frequency oscillator control input, said low frequency oscillator alternately switching between first and second output signal levels corresponding generally to the first and second control input levels, respectively; low pass means operatively associated with the power supply whereby the power supply provides output for full tube illumination when the supply is operated at the first nominal frequency and a substantially reduced output corresponding to low tube illumination when the supply is operated at the second higher frequency; duty-cycle control means operatively connected to the low frequency oscillator to selectively adjust the ratio of time that the output of the low frequency oscillator is in each of its two output levels whereby increased dimming may be achieved by increasing the percentage of time that the high frequency oscillator is operated at the second higher frequency; the output of the high frequency oscillator is a plurality of spaced pulses, means operatively associated with the high frequency oscillator control input for narrowing the width of the spaced pulses as the control input is advanced from first to second levels whereby the relative harmonic content of the high frequency oscillator output increases as the frequency thereof moves between first nominal and second higher frequencies whereby said increases in both oscillator frequency and harmonic content contribute to substantially reduce the output to low tube illumination; the high frequency oscillator includes first and second comparators having outputs connected to the set and reset inputs of a flip-flop, the comparators and flip-flop being operated at a predetermined voltage, the comparators having signal inputs and reference inputs, the reference inputs being biased to first and second bias levels, respectively, whereby the first bias level is less than the second bias level, and both bias levels are less than the predetermined voltage, resistor means and capacitor means operatively connected between the flip-flop output and the signal inputs of the comparators thereby defining an input signal on said comparator signal inputs operatively related to the output of the flip-flop whereby the flip-flop switches between its set and reset conditions when the comparator input signal reaches said first and second bias levels, respectively; the first control input level being defined as the second bias level, the second control input level being defined as a non-zero level less than the second bias level whereby the charge and discharge durations are shortened thereby increasing the frequency of high frequency oscillator and where the ratio of the respective charge and discharge durations is altered thereby causing a narrowing of the pulses and the corresponding increase in high frequency oscillator harmonic output.

* * * * *